United States Patent [19]

Peterson

[11] 4,164,191

[45] Aug. 14, 1979

[54] SEWING MACHINE MOTOR ACTUATED PNEUMATIC PUMP FOR NEEDLE THREADING

[75] Inventor: Wesley R. Peterson, Bound Brook, N.J.

[73] Assignee: The Singer Company, New York, N.Y.

[21] Appl. No.: 952,509

[22] Filed: Oct. 17, 1978

[51] Int. Cl.[2] ..... D05B 69/10; D05B 69/18; D05B 87/00

[52] U.S. Cl. ..... 112/225; 112/275; 12/220; 112/DIG. 1; 192/48.92

[58] Field of Search ..... 112/225, 275, 277, 220, 112/DIG. 1, 279; 192/48.92

[56] References Cited

U.S. PATENT DOCUMENTS

| | | | |
|---|---|---|---|
| 2,082,738 | 6/1937 | Le Vesconte | 112/DIG. 1 |
| 2,943,586 | 7/1960 | Hamlett | 112/279 |
| 2,999,575 | 9/1961 | Schwab | 112/275 X |
| 3,486,472 | 12/1969 | Kaplan | 112/225 |
| 3,635,412 | 1/1972 | Perlino | 112/279 X |
| 4,010,700 | 3/1977 | Webb | 112/220 X |

*Primary Examiner*—Werner H. Schroeder
*Assistant Examiner*—Andrew M. Falik
*Attorney, Agent, or Firm*—Edward W. Goodman; Charles R. Lewis

[57] ABSTRACT

A pump actuating mechanism which allows a sewing machine motor to be used for operating a pneumatic pump. The mechanism utilizes two oppositely arranged, single direction, overrunning clutches, one connected to the sewing machine drive and the other connected to a pump linkage. An electrical switch is used to reverse the direction of the motor rotation thereby disengaging the motor from the sewing machine drive and engaging the motor with the pump linkage.

3 Claims, 7 Drawing Figures

Fig.1
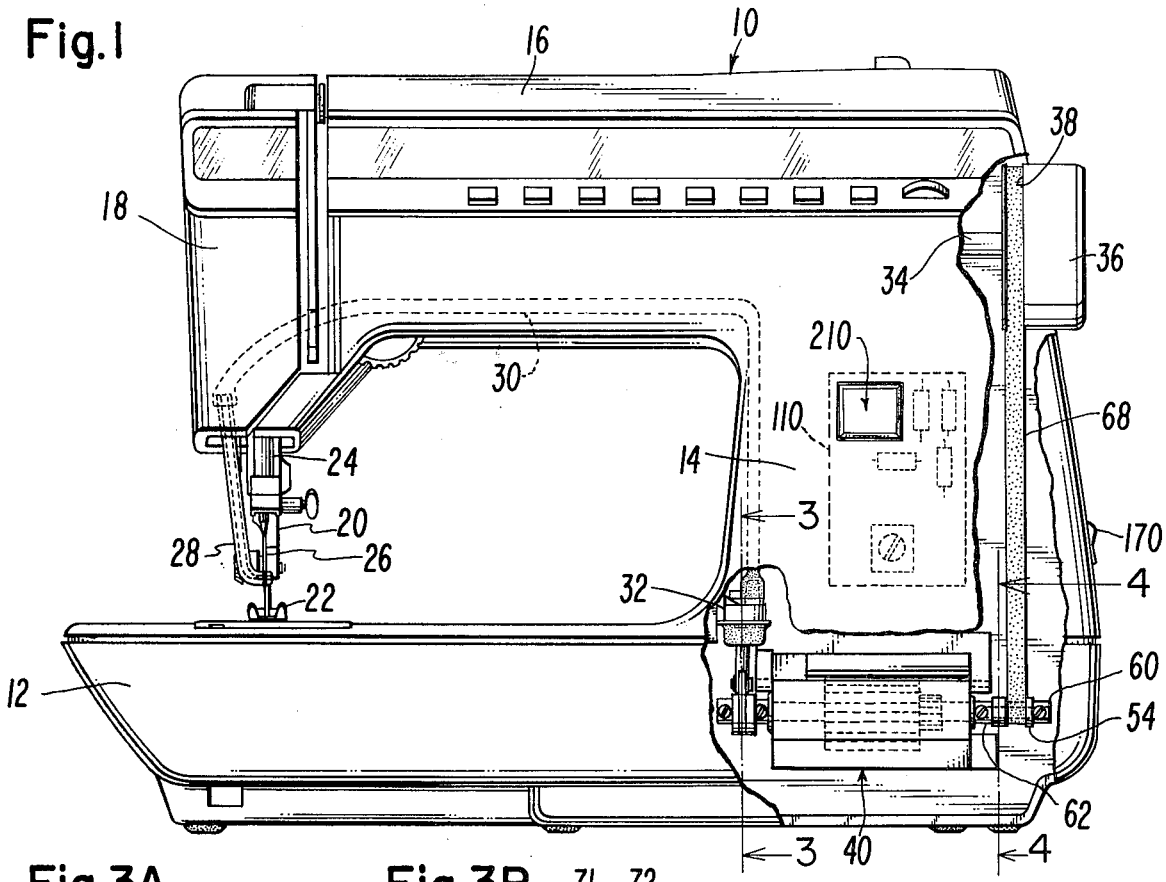
Fig.3A
Fig.3B
Fig.4A
Fig.4B
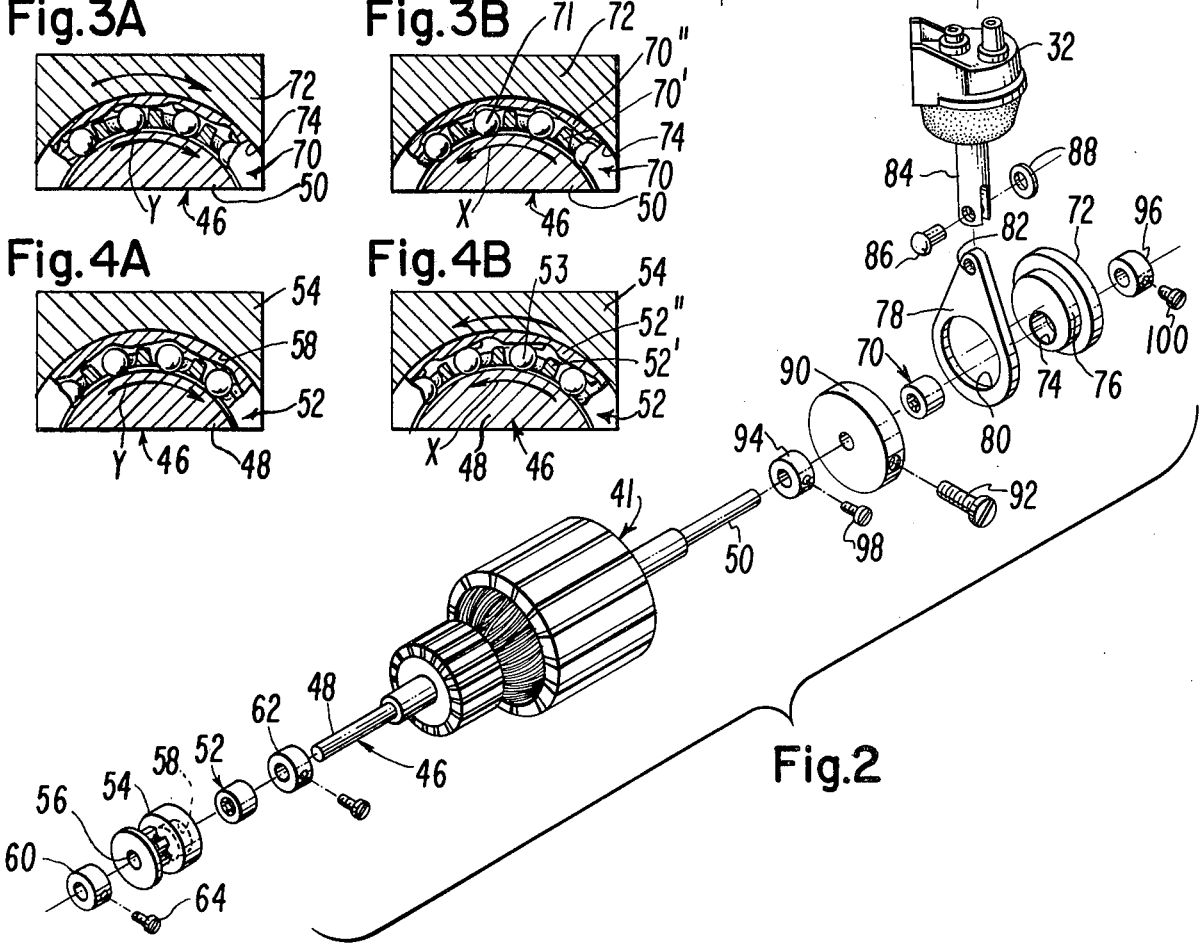
Fig.2

SEWING MACHINE MOTOR ACTUATED PNEUMATIC PUMP FOR NEEDLE THREADING

BACKGROUND OF THE INVENTION

This invention relates to pneumatic pump actuating mechanism, and, particularly, to the use of the aforesaid mechanisms with a sewing machine motor in threading the needle in a sewing machine.

Threading the sewing needle in a sewing machine must be performed periodically during the sewing operation. This being a very tedious task, various devices have been provided to assist the operator, which include pneumatic threading assists. In the past, the air pressure, or vacuum, used with these devices was supplied either external to the sewing machine or by a self-contained electric pump housed within or on the sewing machine frame. In either case, a motor separate from the sewing machine motor is required to operate the pump. Since needle threading is necessarily performed while the stitch forming instrumentalities are stationary, there exists a needless motor redundancy which increase the expense and the probability of failure in providing the pneumatic needle threading assist feature.

SUMMARY OF THE INVENTION

The object of this invention is to provide a mechanism which allows a mechanical pneumatic pump to be driven by the sewing machine motor while the operation of the stitch forming instrumentalities is suspended. This object is achieved by using a first, single direction, overrunning clutch between the motor and the sewing machine drive and a second, single direction, overrunning clutch oppositely arranged between the motor and a pump linkage. An electrical switch is used to reverse the electrical polarity on the motor causing the motor to run in a reverse direction. This effectively causes the first clutch to disengage the sewing machine drive, suspending the operation of the stitch forming instrumentalities, and the second clutch to engage the pump linkage to the motor thereby allowing the sewing machine motor to operate the pneumatic pump.

DESCRIPTION OF THE DRAWINGS

With the above and additional objects and advantages in mind as will hereinafter appear, the invention will be described with reference to the drawings of the preferred embodiment in which:

FIG. 1 is a front elevational view of a sewing machine, partially in section, showing the invention incorporated therein;

FIG. 2 is an exploded perspective view of the sewing machine motor armature with the invention installed thereon;

FIG. 3A is a partial cross-sectional view, taken along the line 3—3 of FIG. 1, showing the relative movement of the pump clutch with respect to the motor shaft;

FIG. 3B is a partial cross-sectional view, as in FIG. 3A, showing the motor shaft rotating oppositely;

FIG. 4A is a partial cross-sectional view, taken along the line 4—4 of FIG. 1, showing the relatively movement of the main drive clutch with respect to the motor shaft;

FIG. 4B is a partial cross-sectional view, as in FIG. 4A, showing the motor shaft rotating oppositely.

DESCRIPTION OF THE PREFERRED EMBODIMENT

Figure 5:
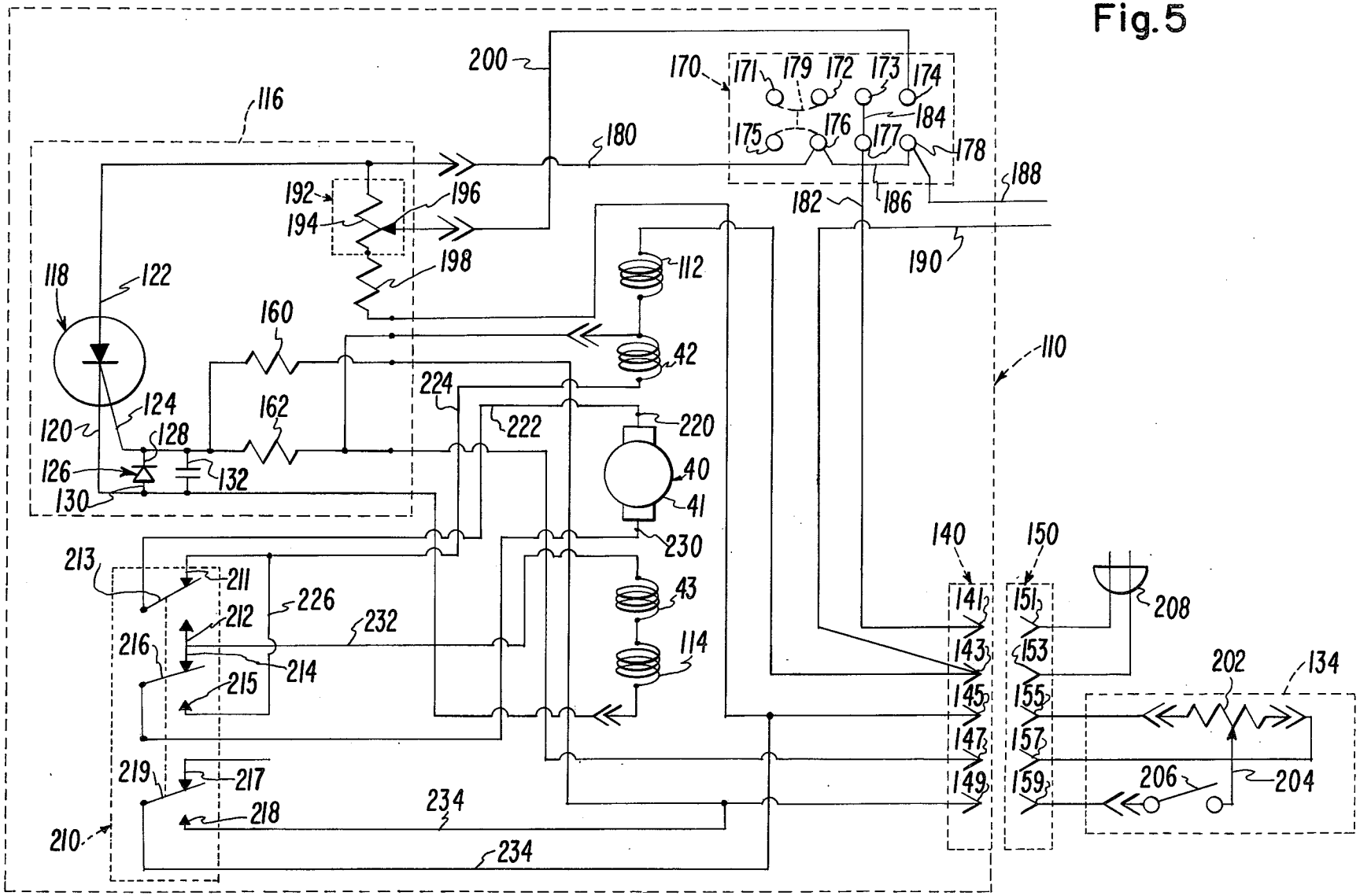
FIG. 5 is a schematic drawing of the sewing machine motor speed control circuit having a reversing feature built therein.

In FIG. 1 there is illustrated a sewing machine 10 having a bed 12, a hollow standard 14 extending upwardly from the bed 12 and a bracket arm 16 attached to the standard 14 and overhanging the bed 12. The bracket arm 16 terminates in a sewing head 18 which carries a downwardly biased presser bar 20, having a presser foot 22 attached to an end thereof. A needle bar 24 is arranged within the head 18 for reciprocatory motion and has a sewing needle 26 attached to one end thereof. A pneumatic needle threading assist 28 is shown in threading engagement with the sewing needle 26. The threading assist 28 may be constructed in accordance with that disclosed in the U.S. Pat. No. 3,599,587, Aug. 17, 1971 of R. G. Greulich to which reference may be had. An air tube 30 is attached to the needle threading assist 28 and extends through the bracket arm 16 terminating at a pneumatic pump 32 secured in the standard 14. A main drive shaft 34 is rotatably carried in the bracket arm 16 for imparting the reciprocatory motion to the needle bar 24. The main drive shaft 34 terminates in a hand wheel 36 having a pulley 38 formed therein.

A motor 40 is provided for driving the sewing machine main drive shaft 34 and the pneumatic pump 32. As shown in FIGS. 2 and 5, the motor 40 includes an armature 41 having electrical windings 42 and 43 wound on a shaft 46 having a first end 48 protruding from one end of the motor 40 and a second end 50 protruding from the opposite end of the motor 40. The first end 48 of the shaft 46 has a first overriding clutch 52 arranged thereon. The clutch 52, which, for example, may be a Roller Clutch no. RC-02 made by the Torrington Company, has an annular shape and includes a clutch element holding member 52', an outer member 52'' formed with clutch element engaging ramps to which outer member drive mechanism may be mounted, and clutch elements 53. The first clutch 52 has the characteristic that when the shaft 46 is turned in a first direction as indicated by the arrow Y in FIG. 4A, the first clutch 52 engages, while, when the shaft 46 is turned oppositely in a second direction as indicated by the arrow Y in FIG. 4B, the first clutch 52 disengages, and conversely, when the shaft 46 turns in a first direction as indicated by the arrow X in FIG. 4B the clutch 52 engages. A pulley 54, having an axial bore 56 therethrough, is formed with an axial counterbore 58 at one end of the bore 56 for receiving the outer member 52'' of the clutch 52 which may be secured therein by any suitable means. A pair of retainers 60 and 62 are arranged on the first end 48 of the shaft 46 on opposite sides of the clutch pulley 54 and the first clutch 52 assembly. Set screws 64 and 66 are used to fix the retainers 60 and 62, respectively, to the first end 48 of the shaft 46. A drive belt 68 drivingly engages both the pulley 54 and the main drive shaft pulley 38, described earlier.

The second end 50 of the shaft 46 is used to drive the pneumatic pump 32. For this purpose, a second overriding clutch 70 is arranged on the second end 50 of the shaft 46. The second clutch 70 is substantially similar to the first clutch 52 in that it includes a clutch element holding member 70', an outer member 70'' formed with clutch element engaging ramps, and clutch elements 71 but is oppositely arranged on the shaft 46 such that when the shaft 46 turns in the first direction as indicated by the arrow X in FIG. 3B, the second clutch 70 disengages and, conversely, when the shaft 46 turns in the second direction as indicated by the arrow Y in FIG. 3A, the second clutch 70 engages. An eccentric 72 is formed with an aperture 74 therethrough within which the outer member 70" of the clutch 70, may be secured by any suitable means. The eccentric 72 has a circular raised portion 76 having a central axis parallel to and displaced from the central axis of the aperture 74. An eccentric follower link 78 is formed with a circular hole 80 therein which slidably engages the raised portion 76 of the eccentric 72. The follower link 78 is further formed with a hole 82 for drivingly attaching the follower link 78 to a drive arm 84 of the pneumatic pump 38 using a pin 86 and a retainer 88. A follower retainer 90 is arranged on the second end 50 of the shaft 46 adjacent the eccentric 72, for holding the follower link 78 on the raised portion 76 of the eccentric 72, and is fastened to the second end 50 of the shaft 46 by a set screw 92. A first retainer 94 is arranged on the second end 50 of the shaft 46 adjacent to the follower retainer 90. A second retainer 96 is arranged on the second end 50 of the shaft 46 adjacent to the eccentric 72. The retainers 94 and 96 are attached to the second end 50 of the shaft 46 by set screws 98 and 100, respectively.

FIG. 5 shows an electrical schematic diagram of the motor 40 and an electronic speed control circuit 110 for controlling the speed of the motor 40. The electronic speed control circuit 110 is substantially similar in design and operation to that described in U.S. Pat. No. 4,098,206 of Suchsland et al which is herein incorporated by reference. The motor 40 is shown as having armature windings 42 and 43 and field windings 112 and 114. A motor control module 116 contains a silicon controlled rectifier "SCR" 118 having a cathode 120, and anode 122 and a gate 124. The "SCR" cathode 120 is connected to the end of the field winding 114. A diode 126 has a cathode 128 thereof connected to the "SCR" gate 124 and an anode 130 connected to the "SCR" cathode 120. In parallel with the diode 126 and connected across the "SCR" gate 124 and the "SCR" cathode 120 is a capacitor 132.

As further shown in FIG. 5, the motor 40 and the motor control module 116 are connected to a foot controller 134 and a power source by means of a socket 140 and a mating plug 150 having terminals 141, 143, 145, 147, 149, and 151, 153, 155, 157, 159, respectively.

A first resistor 160 is shown having one end connected to the "SCR" gate 124 and the other end connected to the socket terminal 149. A second resistor 162 is shown also having one end connected to the "SCR" gate 124 and the other end connected both to the socket terminal 147 and to the junction of the field winding 112 and the armature winding 42. The free end of the field winding 112 is connected to the socket terminal 143.

A switch 170, mounted on the standard 14 is provided for energizing the sewing machine 10 and for selecting between a high and low speed range. The switch 170 has two sets of terminals 171, 172, 173, 174, and 175, 176, 177, 178 and a sliding wiper 179 for interconnecting any two adjacent terminals in each set.

The "SCR" anode 122 is connected to the switch terminal 176 by a lead wire 180. The switch terminal 177 is connected to the socket terminal 141 by a lead wire 182. Jumper wires 184 and 186 interconnect the switch terminals 173 to 177 and 176 to 178, respectively. The switch terminal 178 is also connected to a conventional sewing machine light (not shown) by lead wire 188; the return wire 190 from the light being connected to the socket terminal 143.

A potentiometer 192 is provided for adjusting the maximum attainable motor speed in the high speed range and has a resistive element 194 and a wiper 196. The resistive element 194 is connected at one end to the "SCR" anode 122 and at the other end to a resistor 198, which is, in turn, connected to the socket terminal 145. The wiper 196 is connected to the switch terminal 174 by a lead wire 200.

The foot controller 134 contains a potentiometer having a resistive element 202, connected between the plug terminals 155 and 157, and a wiper 204 connected to an on/off switch 206, which is, in turn, connected to the plug terminal 159. For providing power to the sewing machine 10, a standard 110 volt, 60 cycle plug 208 is shown connected to the plug terminals 151 and 153.

For reversing the polarity on the armature windings 42 and 43 and the field windings 112 and 114 which consequentially reverses the direction of motor shaft 46 rotation, a momentary contact switch 210, also mounted on the standard 14, is provided having terminals 211 and 212, engaged by a lever contact 213, terminals 214 and 215, engaged by a lever contact 216, and terminals 217 and 218, engaged by a lever contact 219. The armature 41 at 220 is connected to the lever contact 213 by a lead wire 222. The armature winding 42 is connected to the terminal 211 by a lead wire 224. A jumper wire 226 interconnects the terminals 211 and 215. A lead wire 228 connects the lever contact 216 with the armature 41 at 230. The armature winding 43 is connected to the terminals 214 and 212 by a lead wire 232. The terminal 218 is connected to the socket terminal 149 by a lead wire 234 and the lever contact 219 is connected to the socket terminal 145 by a lead wire 236.

In operation, the AC plug 208 is connected to a standard 110 VAC source and the switch 170 is moved from a first position thereof to a second position thereof with the wiper 179 interconnecting the terminals 172 and 173 and the terminals 176 to 177, which energizes the sewing machine 10 in the low speed range. Accordingly, the electrical power is supplied to the SCR 118 and to the resistive element 194 of the potentiometer 192, through the resistor 198 and on to the foot controller 134. By advancing the foot controller 134, the switch 206 therein is closed and electrical power is increasingly applied to the SCR gate 124 causing the SCR 118 to energize the motor 40, rotating the shaft 46 in the first direction thereof, disengaging the second clutch 70, connected to the pneumatic pump 38, and engaging the first clutch 32, thereby driving the sewing machine main drive shaft 34 (see FIGS. 3B and 4B). When the switch 170 is moved to a third position thereof, the wiper 179 interconnects the terminals 173 to 174 and the terminals 177 to 178, which allows a portion of the resistive element 194 of the potentiometer 172 to be bypassed by the wiper 196 thereof, effectively increasing the available power supplied to the SCR gate 124 thereby switching the sewing machine 10 to the high speed range.

When it is desired to thread the sewing needle 26 using the needle threading assist 28, without depressing the foot controller 134, the switch 210 is activated, moving the lever contacts 213, 216 and 219 from the terminals 211, 214 and 217, respectively, to the terminals 212, 215 and 218, respectively. This effectively reverses the polarity of the armature windings 42 and 43 and the field windings 112 and 114 causing the motor shaft 46 to turn, at a fixed speed, in the second direction thereof. It may be found preferable to set the switch 170 into the second position for slow motor speed range when threading the needle. In any event, this opposite rotation causes the first clutch 52 to disengage and the second clutch 70 to engage thereby allowing the motor 40 to drive the pneumatic pump 38 (see FIGS. 3A and 4A) to establish a vacuum in the line 30 drawing air into the needle threader assist 28. With this condition established, and the needle threading assist manually positioned opposite the needle eye as shown in FIG. 1, the flow of air into the needle threading assist will draw thread end through the needle eye whenever the thread end is placed in close proximity thereto, thus effecting the otherwise difficult task of threading the needle eye. If this threading operation is initiated when the needle eye is below the work level, the needle will first have to be elevated either manually or by operation of any conventional needle positioning circuit before the threading assist 28 is swung down into cooperative relation with the needle.

When the threading operation is completed the switch 210 may be released and the motor and pump drive will cease to be activated. The threading assist 28 may be retracted and operation of the foot controller will effect the conventional sewing machine drive as described above.

Numerous alterations of the structure herein disclosed will suggest themselves to those skilled in the art. However, it is to be understood that the present disclosure relates to a preferred embodiment of the invention which is for purposes of illustrations only and not to be construed as a limitation of the invention. All such modifications which do not depart from the spirit of the invention are intended to be included within the scope of the appended claims.

I claim:

1. In a sewing machine having a main drive for imparting motion to stitch forming instrumentalities, including a needle bar arranged for reciprocatory motion having a thread carrying needle attached to one end thereof, an electric motor having a rotational drive shaft, and operative connections with said motor drive shaft for imparting rotation to said main drive;

a pneumatic needle threading assist, a pneumatic pump for providing a flow of air through said pneumatic needle threading assist, and a pump actuating mechanism including operative connections with said motor drive shaft including:

a first overriding clutch means arranged in said operative connections for operating said sewing machine main drive, said first overrunning clutch means being arranged to engage said motor with said main drive when said motor is operated in a first direction compatible with the operation of said sewing machine instrumentalities, and to disengage said motor from said main drive when said motor is operated in a second direction, oppositely from said first direction;

a second overriding clutch means arranged in said operative connections included in said pump actuating mechanism, said second overrunning clutch means being arranged to disengage said motor from said pump actuating mechanism when said motor is operated in said first direction, and to engage said motor with said pump actuating mechanism when said motor is operated in said second direction; and means for selectively changing the direction of rotation of said motor.

2. In a sewing machine as set forth in claim 1 wherein said motor is an electric motor having an armature with electrical windings thereon and said means for changing the direction of motor rotation comprises an operator influenced electrical switch for reversing the electrical polarity in the armature windings of said motor.

3. In a sewing machine as set forth in claim 1 wherein said motor is an electric motor having an armature with electrical windings thereon, operator influenced motor controlling means connected electrically to said motor for selectively applying electrical power to drive said motor in said first direction and for regulating the speed of operation of said motor in said first direction, and wherein said means for changing the direction of motor rotation comprises an operator influenced electrical switch connected electrically to said motor for reversing the electrical polarity in the armature windings of said motor and simultaneously applying electrical power to said motor independently of said motor controlling means.

* * * * *